US005173967A

United States Patent [19]

Carter

[11] Patent Number: 5,173,967

[45] Date of Patent: * Dec. 29, 1992

[54] LEG AND ARM PROTECTOR

[76] Inventor: James E. Carter, P.O. Box 291054, Port Orange, Fla. 32129

[ * ] Notice: The portion of the term of this patent subsequent to Jul. 16, 2008 has been disclaimed.

[21] Appl. No.: 730,060

[22] Filed: Jul. 15, 1991

Related U.S. Application Data

[63] Continuation-in-part of Ser. No. 502,059, Mar. 30, 1990.

[51] Int. Cl.[5] ..... A41D 17/02; A41D 13/00

[52] U.S. Cl. ..... 2/242; 2/16; 2/22; 2/62; 2/DIG. 6; 36/2 R

[58] Field of Search ..... 2/2, 16, 22, 23, 24, 2/46, 59, 62, 242, DIG. 6, DIG. 7; 36/2 R; 128/157

[56] References Cited

U.S. PATENT DOCUMENTS

| | | | |
|---|---|---|---|
| 701,445 | 6/1902 | Wood | 2/59 |
| 741,133 | 10/1903 | Haynes | 2/59 |
| 817,416 | 4/1906 | Cather et al. | 2/59 |
| 946,541 | 1/1910 | Fletcher | 2/59 |
| 1,346,448 | 7/1920 | Ewing | 36/2 R |
| 1,577,630 | 3/1926 | Yerger | 2/59 |
| 1,596,158 | 8/1926 | Dempsey | 2/59 |
| 1,762,549 | 6/1930 | Fisher | 2/59 |
| 2,262,564 | 11/1941 | Strother et al. | 36/2 R |
| 2,425,333 | 8/1947 | McCarl | 2/59 |
| 2,904,792 | 9/1959 | Elliott | 2/59 X |
| 3,052,994 | 9/1962 | Johnston | 36/2 R |
| 3,256,882 | 6/1966 | Huber | 2/16 |
| 3,424,153 | 1/1969 | Lewis, Jr. | 2/242 |
| 3,442,270 | 5/1969 | Steinman | 128/540 |
| 3,605,122 | 9/1971 | Myers | 2/242 X |
| 3,879,763 | 4/1975 | Smith | 2/59 |
| 4,110,845 | 9/1978 | Chellis | 36/2 R |
| 4,472,839 | 9/1984 | Johansen | 2/DIG. 6 X |
| 4,503,566 | 3/1985 | Wheeler | 2/22 |
| 4,622,697 | 11/1986 | Tajima | 2/242 X |
| 4,843,645 | 7/1989 | White | 2/59 |
| 4,884,297 | 12/1989 | Triche | 2/59 X |
| 4,964,176 | 10/1990 | Previdi | 2/242 |
| 4,977,622 | 12/1990 | Schley | 2/59 |
| 5,010,597 | 4/1991 | Glover | 2/242 |
| 5,031,247 | 7/1991 | Carter | 2/242 |
| 5,033,126 | 7/1991 | Wruck et al. | 2/242 |

FOREIGN PATENT DOCUMENTS

| | | | |
|---|---|---|---|
| 325782 | 2/1930 | United Kingdom | 2/59 |
| 404651 | 1/1934 | United Kingdom | 2/59 |

*Primary Examiner*—Werner H. Schroeder
*Assistant Examiner*—Jeanette E. Chapman

[57] ABSTRACT

A protective leg or arm covering is manufactured from a single piece of material. The material is cut into a blank having the shape to fit the purpose needed to protect the portion of the leg or arm desired. It is designed to be wrapped around the leg or arm, securing snugly but comfortably in the area of protection from the top of the leg or arm with the lateral edges extending to the bottom of the leg or arm or any partial area in between. A hook and pile closure sewn at the corners of the top and the bottom elevations of said blank of material provides the user with adjustability to the desired snugness of the fit. A hook and pile closure sewn along the lateral edges of said blank of material provides the user with full or partial protection from anything that would penetrate or enter the opening along said lateral edges. The device is light weight, having no metal strips for support or other heavy objects required in its construction, requires nothing to be removed on the leg, foot, or arm to be attached securely to the leg or arm of the wearer, and is quick and easy to put on and take off.

1 Claim, 9 Drawing Sheets

LEG AND ARM PROTECTOR

BACKGROUND OF THE INVENTION

1. Field of the Invention

This is a continuation in part to of Ser. No. 07/502,059 filed Mar. 30, 1990 and relates to protective wearing apparel, and more particularly to comfortable exterior apparel for the protection of the leg and arm from the top of the leg or arm to the bottom of the leg or arm and the individual areas between the top and bottom of the leg and arm.

2. Description of the Prior Art

As man has developed through time, to the present day, he has needed a means in which to protect the leg and arm through these many developmental stages. One such device, as disclosed in U.S. Pat. No. 1,749,789 was needed only when man was able to turn solid metal into molten hot liquid. Prior to this ability to create molten liquid, man had no need for such a fireproof legging.

The same is true of the need that was the source for the development of the parent application and the present invention. No known prior art is known to exist that embodies the spirit of the present invention. The present leg protector was developed to protect the leg from the pain and injury sustained while operating a gas powered string trimmer and the arm protector was developed to protect the arm from being burned by the muffler of a string trimmer and the heat generated from its engine. Because of the recent invention of the string trimmer, this concept for leg and arm protection was only recently created. The present invention addresses this need directly; however, the leg and arm protection provided by the present invention can be applied in many different situations where protection is needed for the leg or arm.

The leg and arm protector offers the user a means of protection heretofore unknown or available and because of the serious pain, burn and/or injury that is caused by said string trimmers a need exists for the protection of the leg and the arm of the user that is comfortable, easy to put on, quick to take off, economical and with the adjustability to fit the leg or arm of different size wearers.

SUMMARY OF THE INVENTION

The present invention provides an inexpensive and lightweight leg and arm protector that secures at the top elevation as well as at the base of the elevation, having full or partial closure of the lateral edges. The present invention is adjustable to the size of the user's leg and arm permitting normal blood circulation for the young and elderly. This is accomplished by the use of a single piece of material; that material composition is determined by what the present invention is protecting from the leg or arm of the user. The amount of closure along the lateral edges is determined by the severity of the element that you are trying to protect the leg or arm from. For example: if the user was trying to protect himself from the effects that spraying harmful chemicals could cause, either from direct contact of the chemical on the skin of the leg or arm or through the permeation of the chemical on the covering of the leg or arm, that material would be manufactured from goods that were resistant to the particular chemical being used. The user would want full closure of the lateral edges to prevent any of the chemical spray or mist from entering along said lateral edges for complete protection. The same holds true if the user was trying to protect his leg or arm from clean, potable water, such as when making adjustments on irrigation systems; that material would be cut from a water repellent material preferably vinyl to prevent the water from being absorbed by the covering on the leg or arm and consequently soaking through making contact with the skin of the user. The need for closure along the lateral edges is not as severe with water as it is with an agent such as harmful chemicals and would require only partial closure along the lateral edges. Further, if the user is protecting his leg during the operation of a string trimmer from the grit and flying debris or his arm from being burned by the muffler or the heat generated from the engine, the material would be cut from preferably moderate to heavy weight cotton goods. The cotton material would offer the user the most comfort, have breathability and be lightweight at the same time. With less of a need for closure along said lateral edges, fasteners located at the top elevation and fasteners located at the base of the elevation provides the user with the needed protection along the lateral edges.

DETAILED DESCRIPTION OF THE INVENTION

Figure 1:
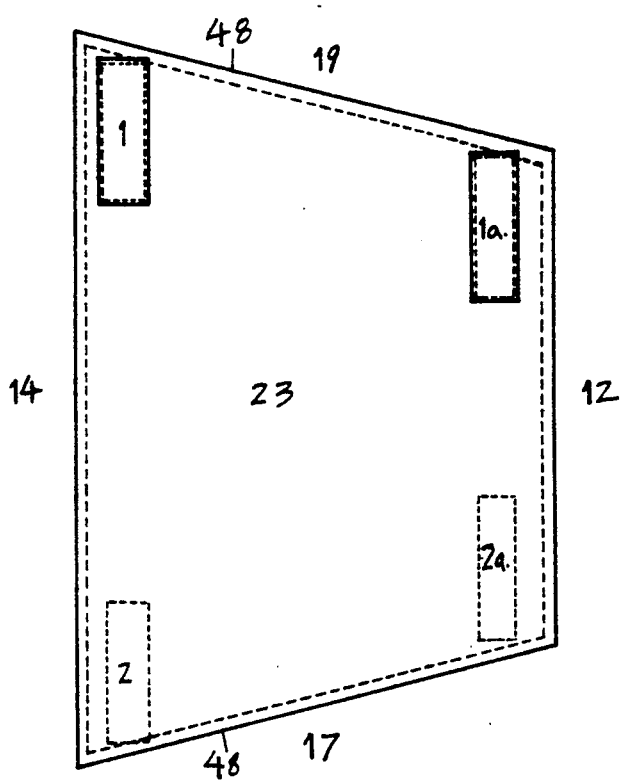
FIG. 1 shows the arm protector laid flat with the upper elevation on the left side and opened out to more clearly illustrate the details of the inside of the arm protector that will be in contact with the arm of the wearer.

As shown in the drawings, the protective articles of clothing of the present invention are a leg and arm protector adapted to be worn around the leg or arm of the user. The leg or arm protector can extend the full length of the leg 49 or arm 33 or it can cover a particular portion of said leg 51, 56 or arm 23 depending on the area that is being protected.

The leg and arm protector is secured by means, preferably of hook 2, 2*a*. and loop 1, 1*a*. fasteners, at both the upper elevation 5, 14 and the lower elevation 9, 12. The lateral edges 48 can be secured FIG. 17 to provide complete protection of the leg or arm of the wearer or any partial degree of closure can be made depending on the amount of protection needed along the lateral edges.

The ability of the present invention's fastener, comprising of hook and loop, to be secured to the user's leg or arm, with as small of an area of 1 inch hook secured to 1 inch loop provides the wearer a wide range of adjustment for leg and arm sizes. The fasteners at the upper and lower elevations of both the leg and arm protector are what allows the protector to adjust and fit snug to such a wide variation of leg and arm circumferences. The hook and loop fasteners 3, 4 along the lateral edges is not near as vital for the fit and snugness of the protector but instead offers the ability to make closure of the lateral edges 48.

With secure closure at both the top elevation of the leg 5 and arm 14 protector and secure closure at the lower elevation of said leg 9 and arm 12 protector and full closure along the lateral edges 48 of each, the user is afforded the best possible protection from the harshest elements presented to man, whether it be natural or man-made.

The one piece construction of the leg 49, 51, 56 and arm 23, 33 protector allows the wearer to put on and take off the present invention without the necessity to remove any article from the leg, foot or arm.

Figure 4:
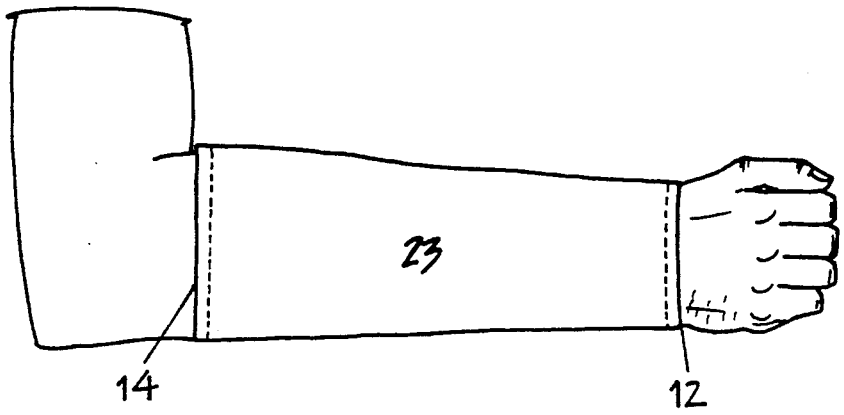
FIG. 4 is an outside view of the arm protector completely applied to a right arm.
Figure 3:
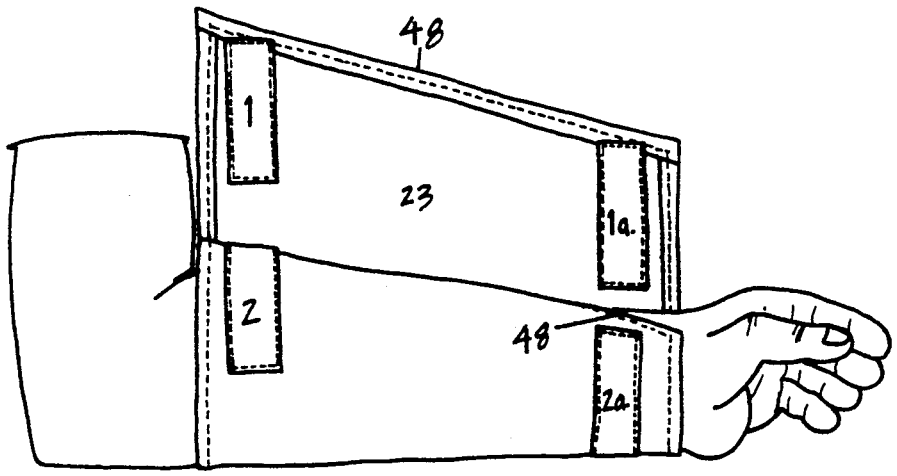
FIG. 3 is a perspective view of a left arm with the arm protector partially applied thereto.

To put the arm protector 23 on, lay the arm protector down flat FIG. 1 and place the forearm, wrist up, in the middle of the arm protector with the wrist in line with the lower elevation 12 and the elbow on the upper elevation 14, pull the outside portion 17 of the arm protector over and rest it on the forearm FIG. 3, pull the inside portion 19 of the arm protector over so that the hook 2, 2*a*. and loop 1, 1*a*. fasteners secure firmly FIG. 4, not allowing the arm protector to slip or slide on the forearm. The full arm protector 33 is put on the same as the aforementioned arm protector FIG. 3 except that an additional fastener has to be secured at the upper elevation 14 FIG. 5. Secured properly, the fit will feel comfortable without the possibility of creating any problems for normal blood circulation or similar discomfort.

Figure 8:
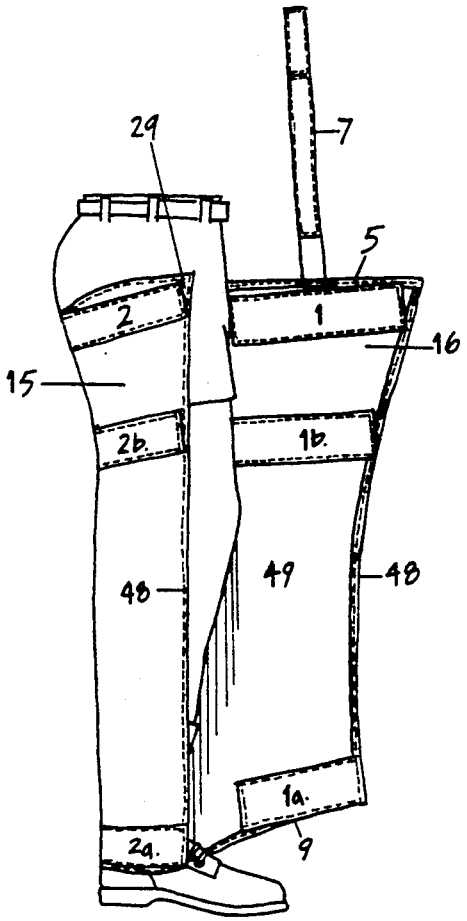
FIG. 8 is a perspective view of a right leg with the full leg protector partially applied thereto.

The full leg protector 49 requires a strap 7 to be attached at the upper elevation 5 to accomodate the weight of the added material needed to extend the protection the full length of the leg. The strap, preferably a webbing material, is secured by hook 2*c*. and loop 1*c*. fasteners sewn on the inside of the strap. The loop preferably being at the top of the strap 31 and 3 inches in length and the hook located right below the loop 32 and extending the strap 7 inches in length and both being 1 inch in width, is placed over the top of a belt 30 FIG. 9 or through a belt loop and pulled down and secured on the inside so that the end of the strap will not be exposed and accidentally caught on something causing separation of the hook and pile closure. The full leg protector FIG. 8 is applied while standing, by placing the leg in the center of the protector 49 with the protector behind the leg. Bring the outside portion of the protector 15 across the front of the leg, pulling firmly and place the corner of the upper elevation against the inside of the upper thigh 29. While holding the outside portion of the leg protector firmly in place, bring the inside portion of the leg protector 16 across the front of the leg pulling firmly while at the same time aligning the hook and loop fasteners. Starting at the upper elevation 5 press the hook and loop fasteners together to form a secure fit and proceed to do the same with the middle fastener 2*b*., 1*b*. and the fastener 2*a*., 1*a*. at the lower elevation 9. Secure the strap as mentioned and adjust for comfort FIG. 9.

Figure 12:
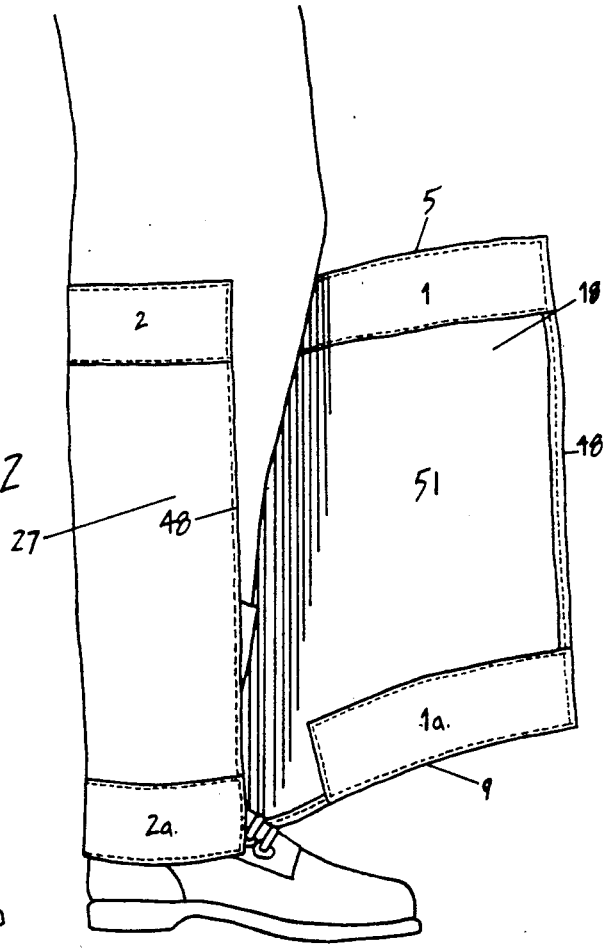
FIG. 12 is a perspective view of a right leg with the smaller leg protector partially applied thereto.

The smaller leg protector 51 is put on by placing the protector behind the leg below the knee area. Bring the outside portion 27 of the protector around and press it firmly against the front of the leg FIG. 12. Bring the inside portion of the leg protector 18 across the front of the leg, aligning the hook and loop fasteners, pull tight and press the fasteners together to form a secure fit FIG. 13. Adjust then for comfort.

The lateral edges 48 on the leg and arm protector can be secured to any degree depending on the amount of closure needed to protect the wearer.

Figure 14:
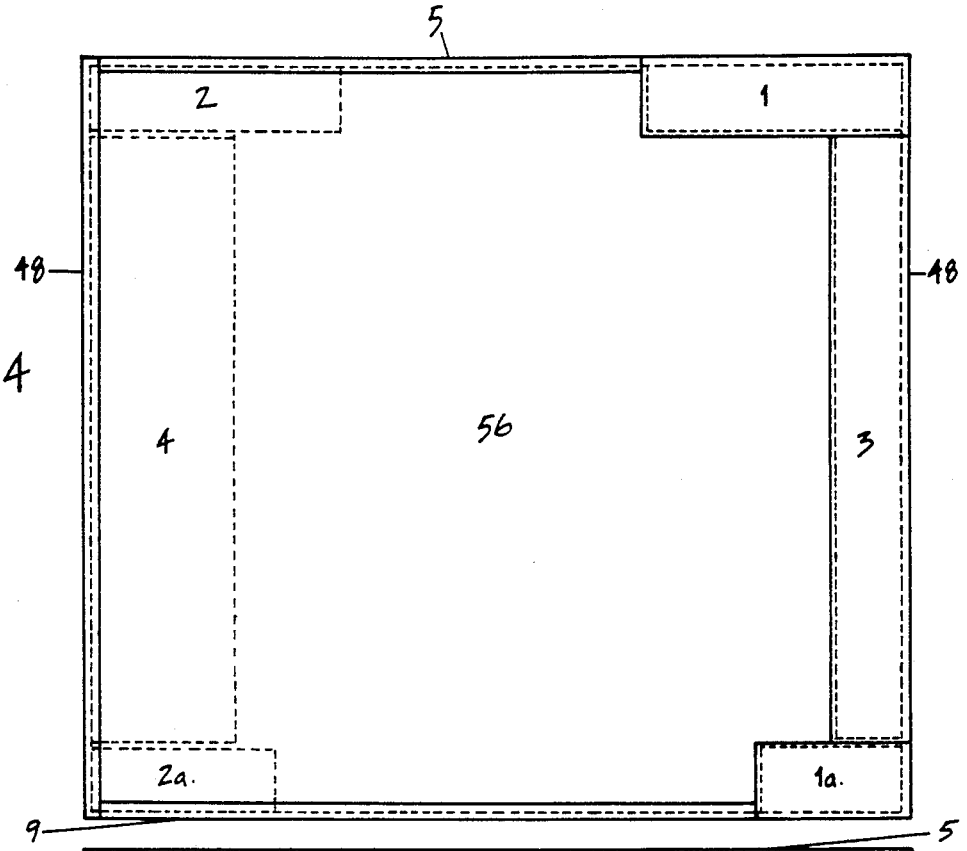
FIG. 14 shows the parent application leg protector laid flat and opened out to more clearly illustrate the details of closure along the lateral edges of the inside of the leg protector that will be in contact with the leg of the wearer.
Figure 15:
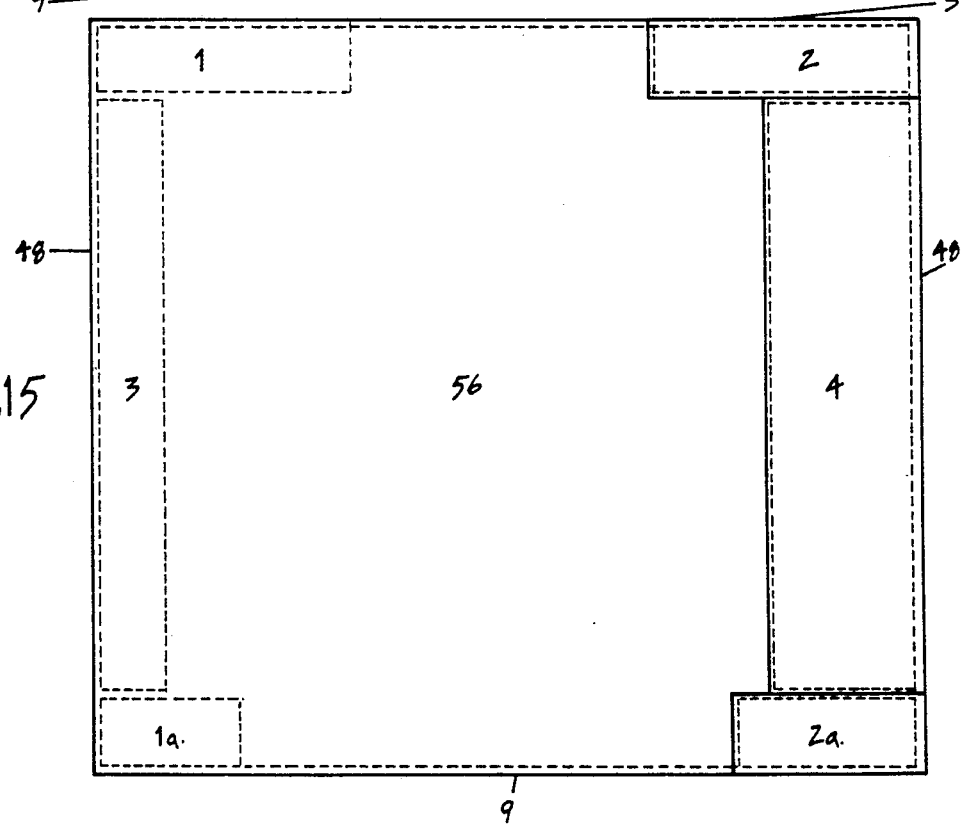
FIG. 15 is a front or outside view of the parent application leg protector. It is the opposite side of that shown in FIG. 14.
Figure 16:
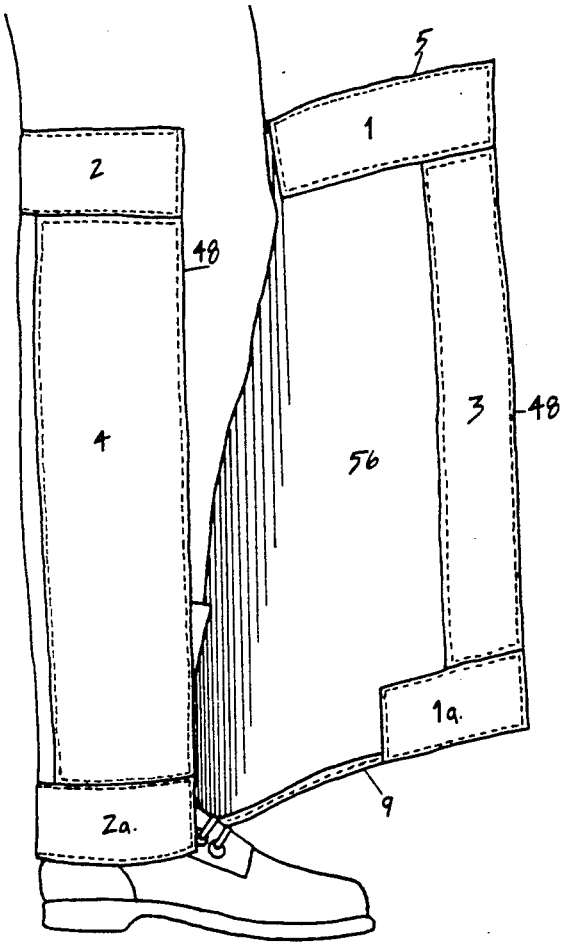
FIG. 16 is a perspective view of a right leg with the lateral edges showing the ability to make full closure.

The method of applying fasteners, preferably hook and loop, to the lateral edges 48 for both the leg and arm protector is illustrated by FIG. 14, FIG. 15. Although the illustrations show closure along the lateral edge of a leg protector 56, the same principle of lateral edge closure can be applied to all leg protectors and all arm protectors. The closure illustrated by FIG. 16, FIG. 17, using 2 inch loop 3 and 4 inch hook 4 fasteners, best suites the need for adjustability of a full closure along the lateral edges for a leg protector given market availability and labor considerations; however, any amount of hook and loop fasteners can be used along the lateral edge to produce the necessary amount of protection for the user.

Figure 5:
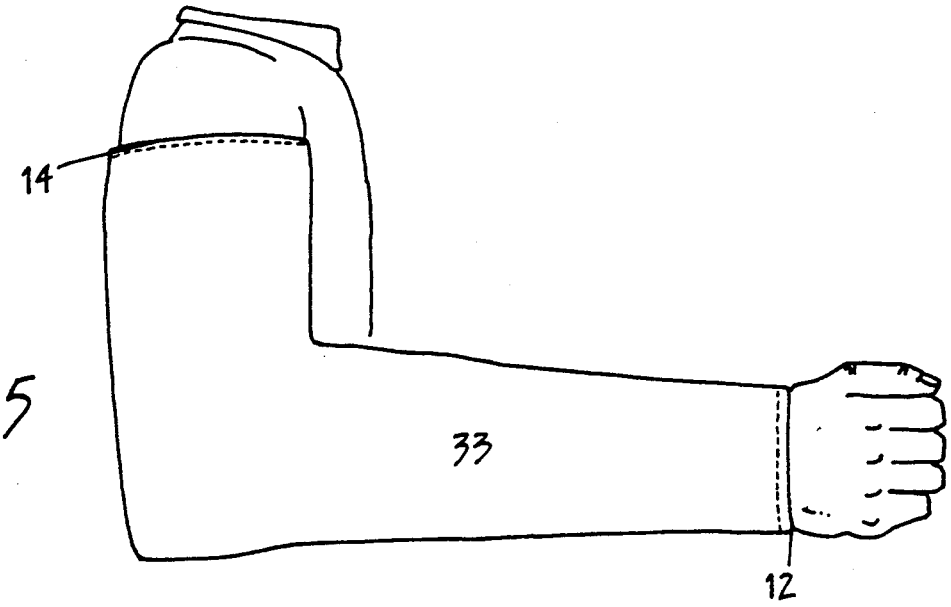
FIG. 5 shows an outside view of a full arm protector completely applied to a right arm.
Figure 6:
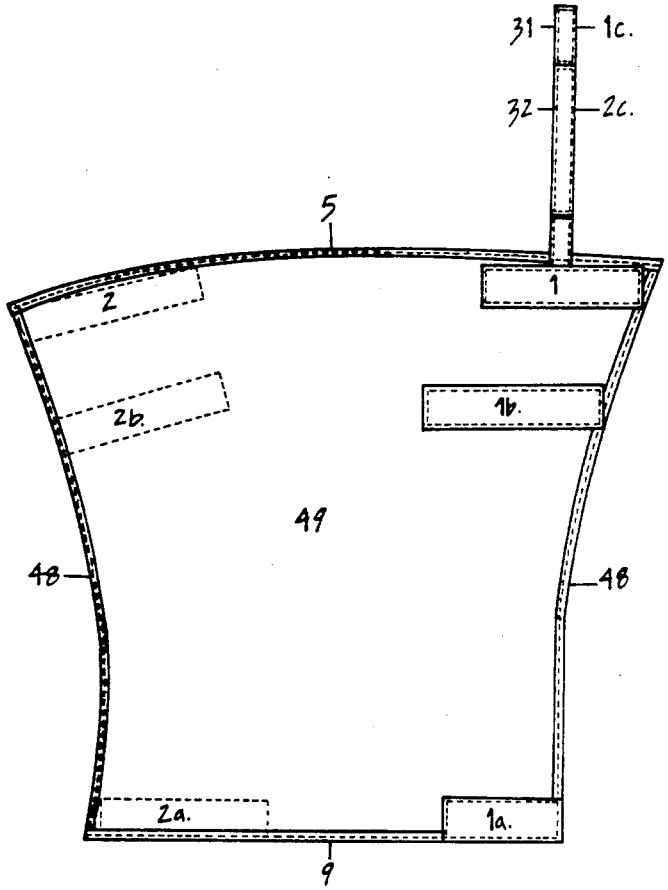
FIG. 6 shows the full leg protector laid flat and opened out to more clearly illustrate the details of the inside of the leg protector that will be in contact with the leg of the wearer.
Figure 7:
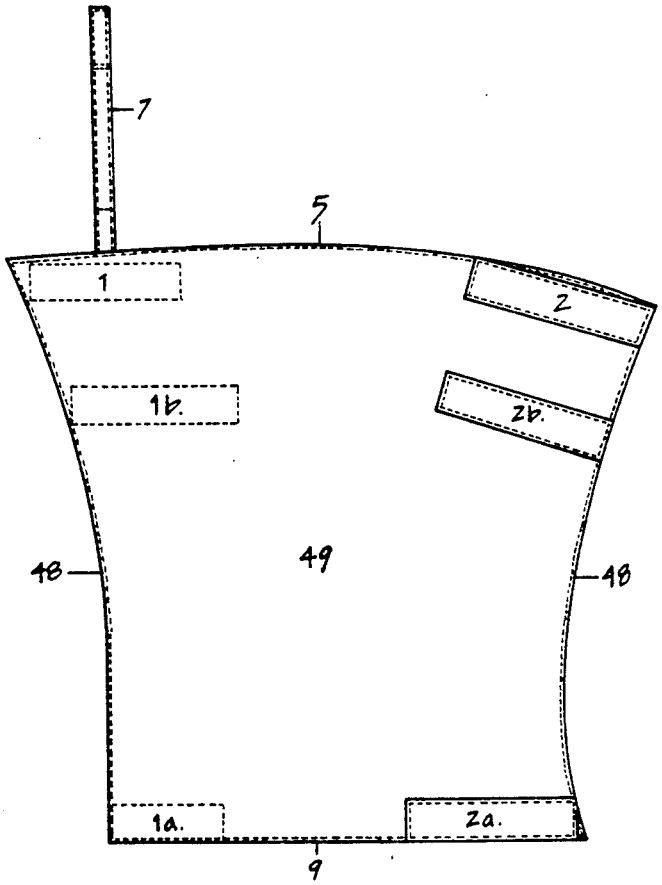
FIG. 7 is a front or outside view of the full leg protector. It is the opposite side of that shown in FIG. 6.
Figure 9:
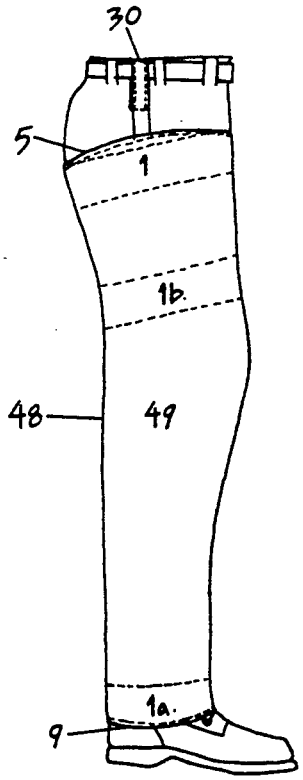
FIG. 9 is a side elevation view of the full leg protector completely applied to a right leg.
Figure 13:
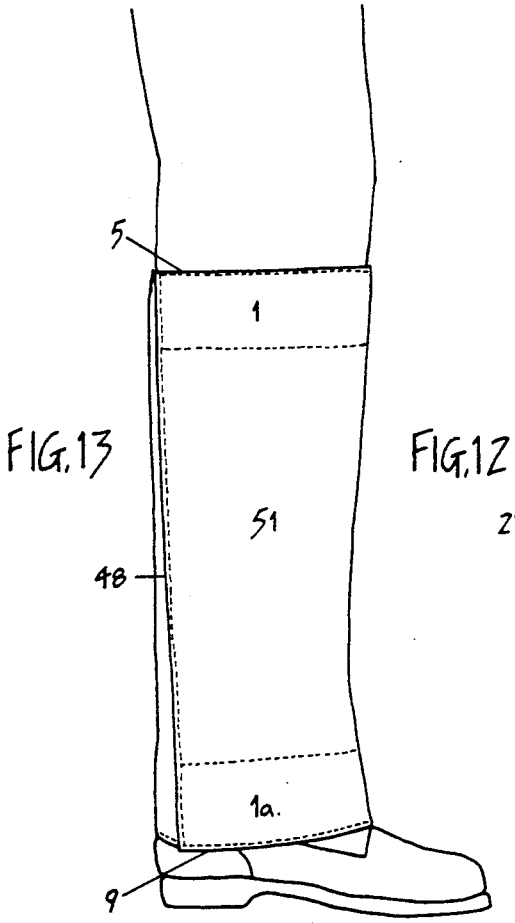
FIG. 13 is a side elevation view of the smaller leg protector completely applied to a right leg.
Figure 17:
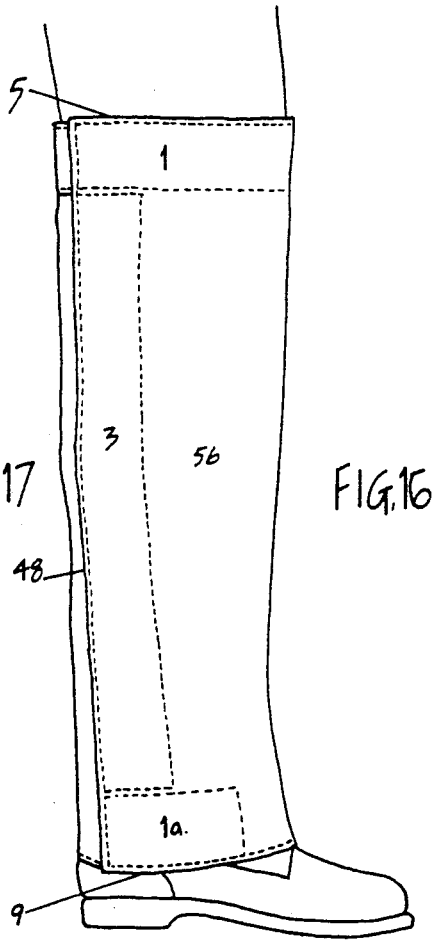
FIG. 17 is a side elevation view of the leg protector completely applied to a right leg with the lateral edges making full closure.

To protect the user to the maximum of the present invention, it is preferable to turn the lateral edge toward the outside of the user's leg and slightly past the halfway point toward the back FIG. 9, FIG. 13, FIG. 17 and to turn the lateral edge of the arm protector to the underside of the forearm FIG. 4, FIG. 5. Positioned properly, a protective unit is formed that has eliminated many of the cumbersome construction devices and tedious securements that have been common to many of the leg and arm protectors heretofore proposed, thus providing a leg and arm protector that not only is lightweight and durable but also offers a means for full or partial closure along the lateral edges and can be put on and taken off with the least possible effort.

The arm protector 23 is preferably 11 inches in length 17, 19, with the upper elevation 14 being 16 inches in width and the lower elevation 12 being 11 inches in width. The full arm protector's 33 length is determined by using long sleeve shirt measurements.

Figure 10:
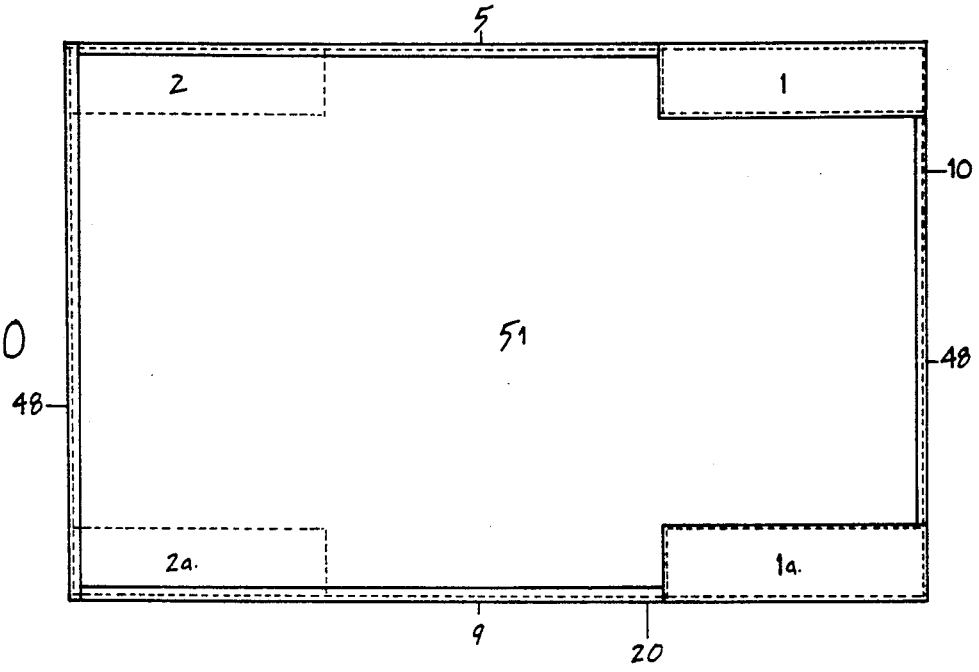
FIG. 10 shows a smaller leg protector, that covers the leg from below the knee down to the top of the foot, laid flat and opened out to more clearly illustrate the details of the inside of the leg protector that will be in contact with the leg of the wearer.
Figure 11:
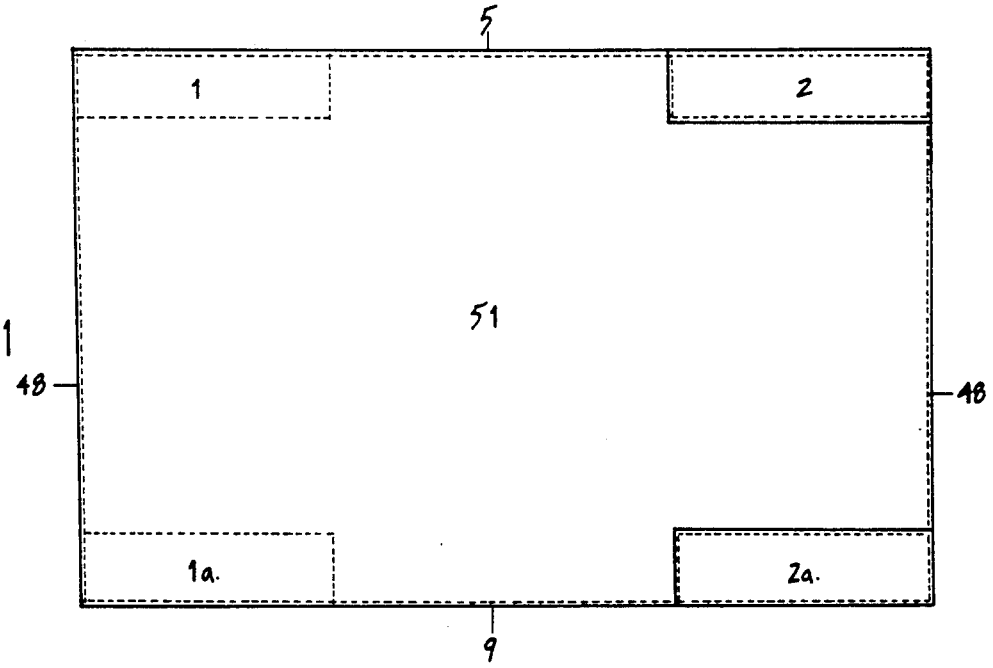
FIG. 11 is a front or outside view of the smaller leg protector. It is the opposite side of that shown in FIG. 10.

The small leg protector 51, is preferably 15 inches to 18 inches in length 10 and 20 inches to 23 inches in width 20, FIG. 10. The full leg protector 49 uses inseam measurements for length and preferably has 30 inches to 35 inches of width at the upper elevation 5 and 24 inches of width at the lower elevation 9.

The measurements are for adult sizes and are only presented to help to better visualize the size that each formal drawing represents. The leg and arm protectors can be made to fit any size leg or arm.

Figure 2:
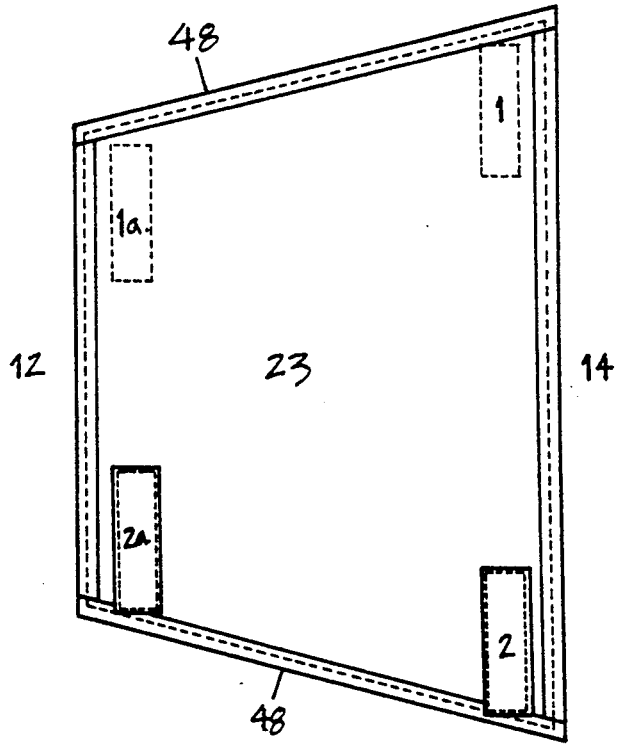
FIG. 2 is the front or outside view of the arm protector, with the upper elevation on the right side. It is the opposite of FIG. 1.

The leg protector 49, 51, 56 has a definite right leg protector and left leg protector. The drawings of all the leg protectors were for the right leg. The description, application and illustrations presented for the right leg applies the same for the left leg. Having a definite right arm protector FIG. 1, FIG. 2 and left arm protector is not as important for their effectiveness as it is for the leg protector; however, the principles of a right arm protector and left arm protector can be applied.

It is apparent that the objects, aims and advantages already stated above have been fully satisfied by the present invention. Although the present invention has been described in relationship with specific embodiments, it is obvious that anyone with a sense of design or an understanding of how it is that the leg and arm can be best protected could make changes and take from the strength, simplicity and spirit of the present invention. Therefore, it is requested not to be bound by the foregoing except as may be required by the claims.

Having thus described the present invention I claim:

1. A limb protector for human legs or arms covering the full length of said limbs comprising a sheet of material cut in a shape to fit an area of said human legs or arms that are being protected having a pair of lateral and a pair of horizontal edges adapted to be formed into a tube to surround the legs or arms having means for fastening the lateral edges of said sheet to form the tube; said fastening means comprising patches of hook and loop fasteners placed at said lateral edges along said pair of horizontal edges, with additional horizontal patches of said fasteners placed near the middle of said sheet for the full leg and full arm protector and extending a needed length along said lateral edges for complete or partial closure of said lateral edges, one of said patches placed at one of said horizontal edges being slightly longer than the other of said patches at the other lateral edge and one of said patches placed at one of said lateral edge being slightly wider than the other of said lateral edge to increase the range of adjustability of said fastening means.

* * * * *